US007021231B2

(12) United States Patent
Smart

(10) Patent No.: US 7,021,231 B2
(45) Date of Patent: Apr. 4, 2006

(54) VESSEL NAVIGATION AND DOCKING SYSTEM AND METHOD

(76) Inventor: Billy-Jay Smart, 8, Avenue des Ligures, Monaco (MC) MC 98000

( * ) Notice: Subject to any disclaimer, the term of this patent is extended or adjusted under 35 U.S.C. 154(b) by 0 days.

(21) Appl. No.: 10/496,843

(22) PCT Filed: Nov. 29, 2001

(86) PCT No.: PCT/GB01/05268

§ 371 (c)(1),
(2), (4) Date: May 27, 2004

(87) PCT Pub. No.: WO02/44013

PCT Pub. Date: Jun. 6, 2002

(65) Prior Publication Data

US 2005/0005833 A1 Jan. 13, 2005

(30) Foreign Application Priority Data

Dec. 1, 2000 (GB) ..... 00293720

(51) Int. Cl.
*B63B 21/00* (2006.01)

(52) U.S. Cl. ..... 114/230.17; 114/230.21

(58) Field of Classification Search ..... 114/230.21, 114/230.17, 230.1, 293, 230.25, 230.23, 230.15, 114/230.14, 218
See application file for complete search history.

(56) References Cited

U.S. PATENT DOCUMENTS

| | | | | |
|---|---|---|---|---|
| 4,281,611 | A * | 8/1981 | Vilain | 114/230.14 |
| 4,708,082 | A | 11/1987 | Ohta et al. | 114/230.1 |
| 4,729,332 | A * | 3/1988 | Ohta et al. | 114/230.23 |
| 5,540,175 | A * | 7/1996 | Van Den Haak | 114/293 |

FOREIGN PATENT DOCUMENTS

| | | |
|---|---|---|
| DE | 245 736 | 5/1987 |
| GB | 1 395 886 | 5/1975 |
| JP | 61094888 | 5/1986 |
| WO | WO 91/14615 | 10/1991 |
| WO | WO 95/18038 | 7/1995 |

OTHER PUBLICATIONS

Patent Abstracts of Japan, vol. 007, No. 254 (M-255), Nov. 11, 1983 & JP 58 136585 A (Hitachi Zosen KK), Aug. 13, 1983 abstract.

* cited by examiner

*Primary Examiner*—Lars A. Olson
(74) *Attorney, Agent, or Firm*—Young & Thompson

(57) ABSTRACT

A system configured to auto pilot and dock automatically a vessel (108), the system comprising: one or more distance detectors (106): at least one extendable arm (104), the arm including attachment elements (112) located at a far end thereof; and a control system (102) configured to activate the arm (104) and attachment elements (112) to link with a dockside (110). The present invention provides a method and system for auto piloting and docking automatically a vessel (108). This invention enhances safety and enjoyment in open seas, rivers, channels, harbours, marinas and the like for vessel operators and for others.

18 Claims, 3 Drawing Sheets

VESSEL NAVIGATION AND DOCKING SYSTEM AND METHOD

Figure 1A:
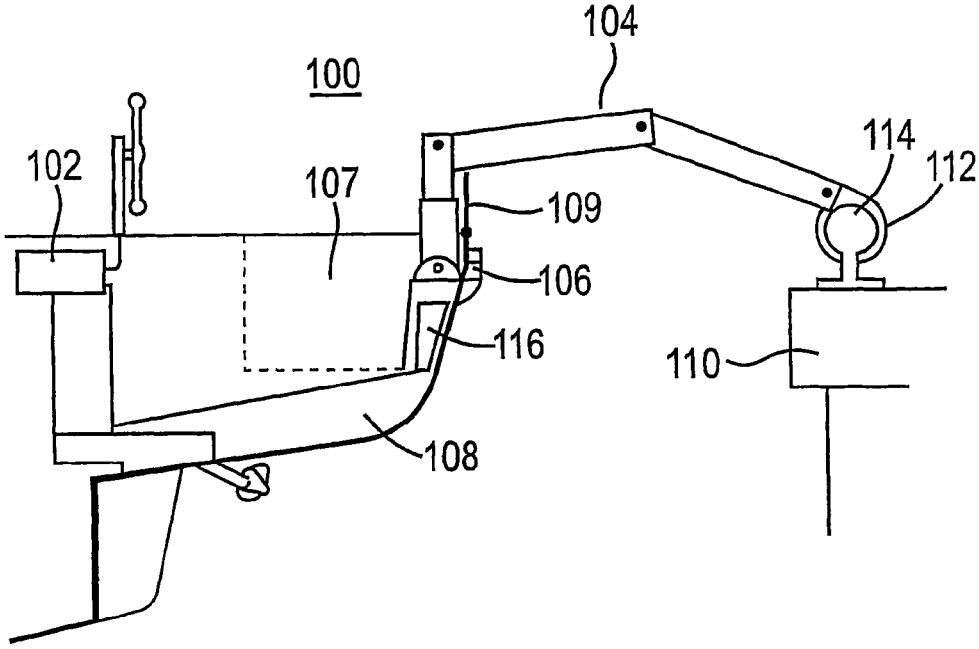

The present invention relates to a method and system for controlling, docking or berthing a vessel, such as a yacht, a motor cruiser or a ship. More specifically, this invention relates to a method and system of controlling a vessel without the need for the exercise of human skill in the handling of the vessel.

At the present time, when the person (or persons) controlling a vessel wishes to navigate, manoeuvre, dock or berth that vessel, it is required that they employ experience and skill in manoeuvring that vessel. That person must take into account such things as tides, currents, weather conditions, etc. In some difficult ports or moorings, it is required that a pilot, who has significant local knowledge and experience, carry out the docking procedure. An example of this is a Bristol Channel pilot, who may be required to bring a ship up the Bristol Channel and dock it at the Avonmouth Docks.

Quite clearly, many users of vessels will not have the skills required to handle a vessel in some conditions or in some locations, or may find themselves in situations where their skills and experience are lacking. This may reduce the enjoyment of the vessel operator, and may cause undue risk or danger to be experienced, resulting in a lack of safety at sea or on other bodies of water. As such, there is a need to combat the above, in order to enhance safety at sea, on rivers or lakes and in ports, harbours, docks, marinas and the like, and to increase the control of the vessel operator.

In view of the foregoing, the present invention provides a system configured to navigate and to dock automatically a vessel, the system comprising:

one or more distance detectors;

at least one extendable arm, the arm including attachment means located at a far end thereof; and a control system configured to activate the arm and attachment means to link the vessel with a dock side or other vessel. An anchor and winch or equivalent means may be further incorporated in the system.

Preferably, activation of the at least one arm is triggered when a pre-set distance to the dockside and/or means provided for engagement is measured by the one or more distance detectors.

In a preferred embodiment of the present invention, the at least one extendable arm is located adjacent the perimeter of the vessel and a distance detector is located adjacent thereto, in order to detect objects in the vicinity of the vessel. Preferably, the arm and detector are located in the stern of a vessel and/or to either/both side(s).

Preferably, the control system includes a store for storing at least one chart and/or harbour/dock/mooring plan. The control system may comprise means for selecting a location within the plan or a suggested route within the chart. The chart or mooring plan, etc., may be updated continuously, periodically or occasionally, via connection with a central server or system configured for this purpose. This will enable the inclusion of sea bed slippage or sand bank discovery, for example, within a chart or plan.

In accordance with a still further preferred embodiment of the present invention, the extendable arm is controlled by hydraulic means. Preferably, the extendable arm is stored, when withdrawn, in a hold covered by a hatch within the vessel. The hatch may include means for closing of the hatch, upon withdrawal of the arm from an extended position.

Also in accordance with the present invention there is provided a method of automatically docking a vessel, comprising the steps of:

positioning the vessel, utilising the vessel's movement and steerage means and measured distances to other objects, adjacent a desired berth; and extending at least one extendable arm including attachment means to cause the vessel and the berth to be linked.

Preferably, the method includes the further steps of measuring wind speed, tide and/or current. More preferably, the method further including dropping anchor.

Preferably, the method comprises the further steps of providing from a store a chart or plan of the harbour/dock of interest; and receiving an indication of the location for berthing.

Figure 1B:
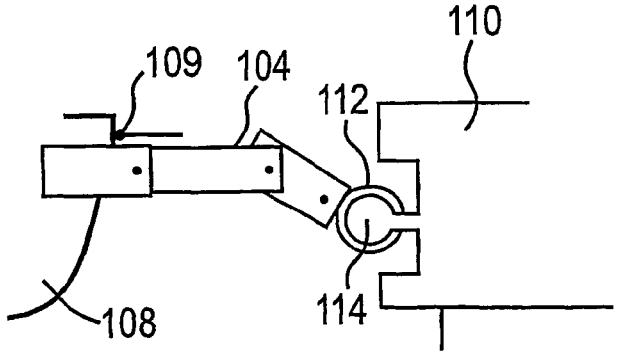

A specific embodiment of the present invention is now described, by way of example only, with reference to the accompanying drawings, in which:

FIG. 1*a* is a cross-sectional view of a docked vessel incorporating representations of elements of a system according to the present invention;

FIG. 1*b* is a view of an alternative to the embodiment of FIG. 1*a;*

Figure 2:
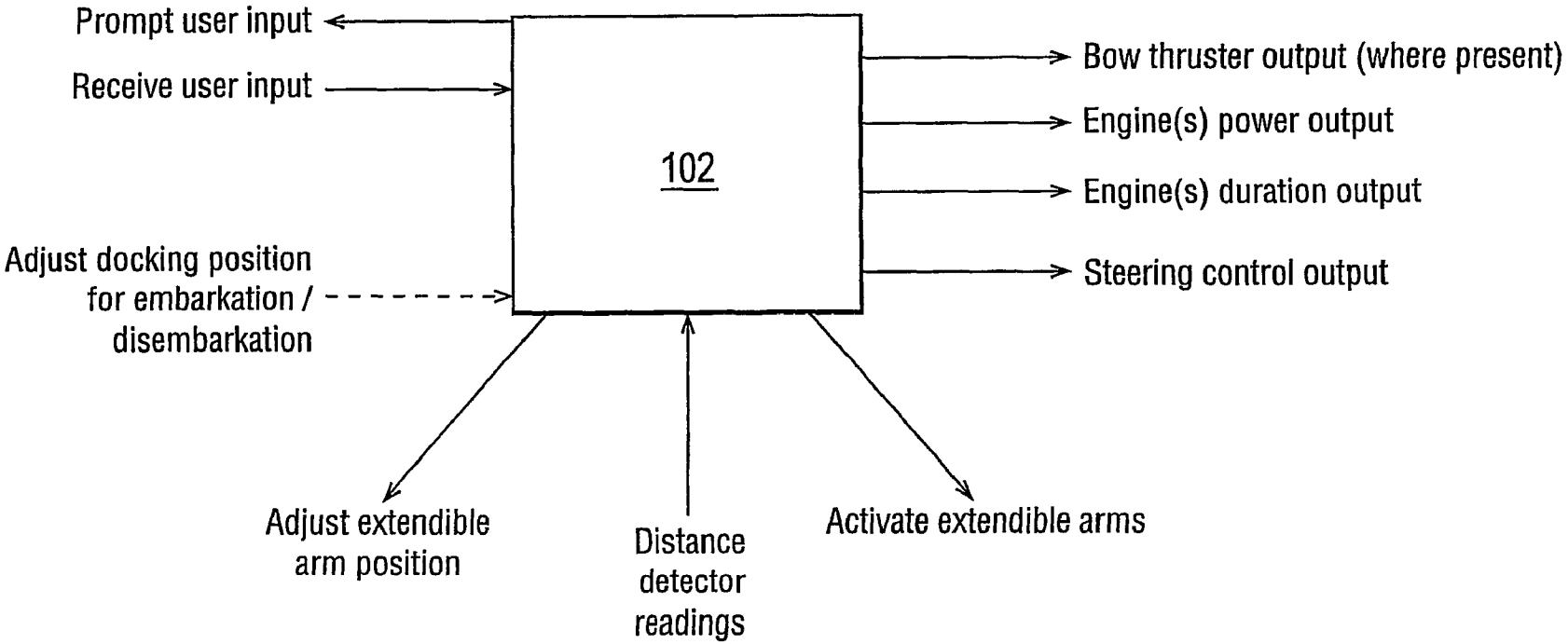
Figure 3A:
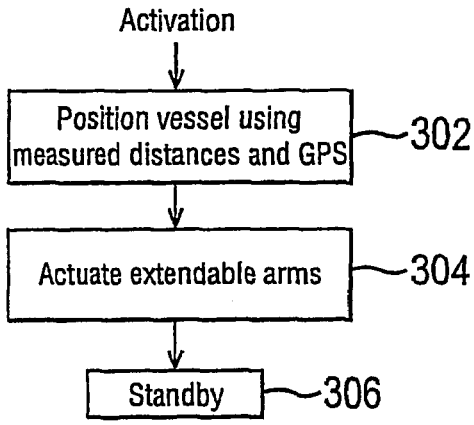
Figure 3B:
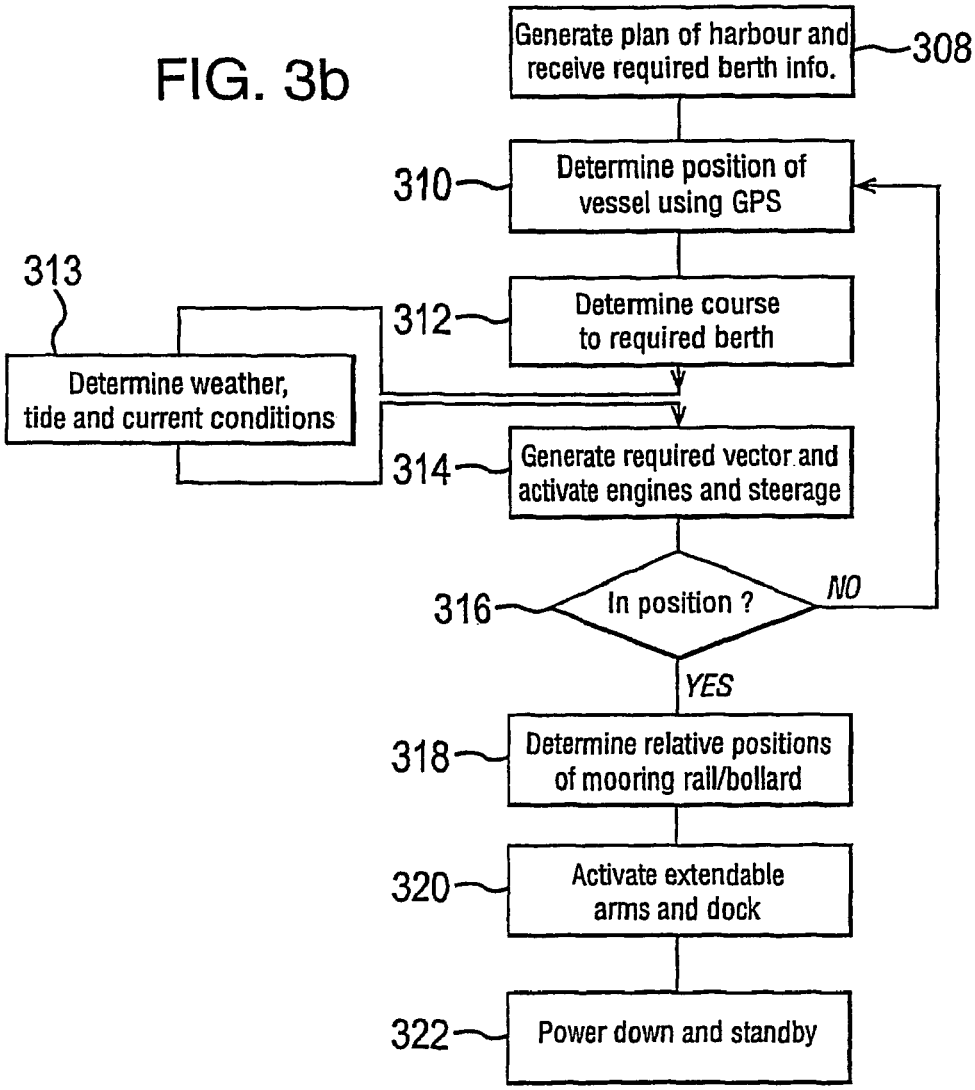

FIG. 2 is a diagram illustrating the signals or instructions received and generated by a control system according to the present invention;

FIG. 3*a* is a flow diagram illustrating the operation of a system in accordance with the present invention; and FIG. 3*b* is a detailed flow diagram depicting the method of FIG. 3*a*.

Referring now to FIG. 1, the system 100 of the present invention includes a number of different pieces of apparatus. Firstly, there is an automatic control system 102. The control system, as will be described with reference to FIG. 3 below, utilises various signals input to it to manage the control of a vessel in which it is installed, once activated.

The system 100 of the present invention also includes at least one extendable arm 104 and a distance detector or sensor 106. The distance detector 106 provides a measurement of distance between the vessel 108 and an object in the detection area of the detector. In the embodiment of FIG. 1, the extendable arm 104 and detector 106 are located at the stem of a vessel 108. Of course, this arrangement, or simply one or more distance detectors, may be located in other areas of a vessel 108, e.g. bow, port and/or starboard, thereby enabling the measurement of distance to other vessels, etc., docked or positioned around the vessel. Hence, the detector measures the distance between the stern of the vessel 108 and a dockside, for example, in order to prevent a coming together thereof, and the same, or another, detector measures the distance to a mooring device, as described below. The detector 106 may be one of an ultrasonic distance detector or a laser distance detector, for example.

When the vessel 108 is in the correct position for attachment to a jetty or quay, for example, the extendable arm 104 is caused to emerge from a hold 107 within the vessel 108. As may be seen in FIGS. 1*a* and 1*b*, the point of emergence of the arm may be in the deck of the vessel or in the hull of the vessel. When emerging, the arm causes the opening of a hatch 109 covering the hold. Similarly, the withdrawal or stowing of the arm 104 causes the closure of the hatch 109. This may be achieved by the hatch 109 being spring-biased toward closure, or by way of catch means, attached to both at least one arm 104 and hatch 109, which connect upon withdrawal to cause closure of the hatch 109. Alternatively, the hatch 109 may be manually removable or replaceable, or controlled by electric or hydraulic means.

When the arm has emerged, it is caused to extend over the side of the vessel 108 towards the quay or dockside 110, where grip means 112, at the far end of the arm, is caused to interlock with a bollard or railing 114, for example. The arm 104 is hydraulically operated and comprises an appropriate number of links to enable the connection of the grip means with the bollard or railing. This, of course, is vessel 108 specific. However, the hydraulic arm may be spring-loaded and may have swivel joints on one or either end in order to retain flexibility.

An advantage of the extendable arm arrangement is the fine tuning of the docking process. The arm can be activated to pull the vessel 108 closer to a dockside to facilitate dis-embarkation, and to push the vessel 108 further from the side to a preferred docking position. This procedure may be activated by remote control to facilitate disembarkation and re-embarkation.

In a particular embodiment of the invention, the arm is driven by the vessel engines or by auxiliary power such as a 12 volt or 240 volt battery. Further, the extendable arm possesses a drive system 116. In a further embodiment, an extendable arm, such as that described above, is fitted on one or both of the port and starboard sides of a vessel 108, and distance detectors are also so fitted. These serve the extra purpose of preventing a coming together, side on, with other vessels, etc. and allow side on docking/berthing.

The railing 114, present on the dock or quayside 110, may be smooth. However, in order to prevent the grip 112 sliding along the railing, it may be ridged or ribbed or grooved. Therefore, when the grip makes contact with the railing, it may be located automatically in a trough and thus will be prevented from lateral movement.

When the railing 114 is configured horizontally, it is necessary for the height of the railing 114 only to be sensed, in order that a satisfactory coupling may be achieved by the system. This is the case especially where the provided railing 114 is continuous along the dockside, for example. However, if the railing 114 is in the form of a bollard, for example, the position thereof along the length of the dockside will also have to be determined by the system. In such a situation, there will be provided at least one further joint within the arm 104, in order to accommodate the required motion to couple with the bollard.

One (or more) extendable arm 104 may have a waterproof plug at a far end thereof. The plug is wired into the vessel's electric systems, as appropriate, enabling recharging of vessel batteries and/or the running of the vessels electronic systems using a mains (shore based) electricity supply. In this case, the railing 114 may be similarly equipped, with a plug fitting capable of engagement with that on the arm, such that docking incorporates electrical supply connection.

An anchor or the anchors of the vessel may also be controlled or controllable by the system. Because the system knows the position of the vessel relative to a desired berth (as will be described below), it can drop the anchor at a required time, which may depend upon the depth of the dock and may be pre-programmed by the user. The system determines when the anchor has hit the sea/river bed utilising depth sensors, one or more sensors to determine the amount of anchor chain/cable paid out, and sensors determining the tension of the anchor chain/cable. The system further winches in the cable to achieve a desired and pre-set tension for the chain/cable. Larger boats may require this additional feature to prevent too much sideways strain on the extendible arm(s) and the fixings thereof.

Control of the system is now described with reference to FIG. 2. The control system 102 receives various signals to enable it to function. Firstly, when at sea, etc., the system receives inputs regarding prevalent weather conditions and currents, etc. This information is combined with information available from a stored chart to determine the best route to take, i.e. avoiding obstacles, in order to reach a required destination. Criteria for the best route may be the fastest route, the safest route and the most economical route. Such requirements/criteria may or may not be mutually exclusive. If they are, the operator may select from the alternative routes provided. Such navigation may be activated by an operator at any time.

When docking, the system receives distance measurements from the detectors located around the perimeter of the vessel 108 (where present). These measurements indicate to the control system the proximity of the quayside 110, the proximity of the mooring rail 114 and, where side detectors are utilised, the proximity of any other vessel or object alongside the vessel 108. Depth measuring devices may determine when it is necessary to drop anchor. Such determination will take account of length of anchor cable, depth of berth, position of vessel, etc. Of course, the system will be supplied with parameters relating to the vessel in which it is installed. Such parameters will include length, beam, draught, displacement, etc. These are likely to be input to the system during installation.

However, the displacement and draught of the vessel may change, depending upon its current load conditions for example. Accordingly, the displacement and/or draught of the vessel, or variations therein, may be monitored by a water sensor strip positioned on the vessel such that it bisects the waterline. The strip may be positioned in the vertical plane and may run from a highest waterline to a lowest waterline. The system is therefore updated as to the prevalent displacement and/or draught of the vessel. Such updates may occur continually, or periodically and/or upon the start-up of the system, for example.

The depth of water below the deepest point of the vessel's hull may be continually monitored during the docking procedure, in a preferred embodiment. In this way, the running aground of the vessel may be averted.

In addition to the above, the control system 102 receives user input and prompts the user/operator for input. An example of this is, upon reaching a harbour, the operator activates the system for docking. The system then prompts for a harbour identifier, i.e. an identification of the harbour in which the vessel 108 is to berth. Upon receipt of this, the system accesses its store of such harbours and produces the relevant harbour plan. The operator is then prompted for a location, within the plan, to dock the vessel 108. The charts and/or plans stored within the system can be continually updated from a central resource or database, via the internet, for example.

Utilising the above information and processing it alongside a detected global positioning system identification of location, the system 102 produces the output to the vessel's engine(s) (both directional and power) and steering to move the vessel 108 to the required point. The vessels position is continually updated using GPS and collision is avoided utilising the output of the distance detectors. Once in position (which will vary immensely, in terms of distance, depending upon vessel size), the system 102 activates the extendable arms, causing docking of the vessel 108. The system 102 is also responsive to remote user signals to move the boat in towards the quay/other vessel or to move it further therefrom.

The operation is now described with reference to FIGS. 3*a* and 3*b*. As may be seen in FIG. 3*a*, upon activation, for docking, of the system, the vessel 108 is positioned for mooring utilising the distances supplied to the control system by the various distance detectors present around the perimeter of the vessel 108 and utilising the ships position determined by global positioning system (Function Box 302). Once the vessel 108 has reached a predetermined position with regard to the dockside it will drop anchor(s), then at a predetermined position the extendable arm is activated (Function Box 304) in order that it causes to be gripped, by gripping means 112, a railing present on the dockside, and causes the vessel 108 to be moored. At this point, the system moves to a standby state in order that it may adjust the position of the vessel 108 with regard to the dockside upon instruction from the vessel operator (Function Box 306).

The above method is set forth in greater detail in FIG. 3*b*. As may be seen, upon activation by the user the system generates a plan of the harbour in which the vessel 108 is to be docked, prompts the user for the location at which the vessel 108 should be docked, and receives that information (Function Box 308). The system also receives information relating to weather and tide conditions, as well as draught and/or displacement, and the output of the various measuring devices situated on the vessel.

Once this has been done, the system determines the position of the vessel 108, within the generated plan, utilising a global positioning system (Function Box 310). Once the position of the vessel 108 is known, the system determines the course required for the vessel 108 to reach the required docking position or berth (Function Box 312) and the correct point at which to drop anchor(s). The prevalent weather, tide and current conditions are determined (Function box 313) utilising meteorological and other sensors present within the vessel and interactive with the system. The required vector is then generated and the engines and steerage system of the vessel 108 are caused to move the vessel 108 along that vector (Function Box 314).

The next step is to determine whether or not the vessel 108 is in a position for mooring to be completed (Function Box 316). If the vessel 108 is not yet in the correct position, Function Box 310 is returned to and the process is run through again. However, if the vessel 108 is in the correct position the system determines the relative position of the mooring rail 114 (Function Box 318) and activates the extendable arm such that it moves to the correct position of the mooring rail 114 and the grip means 112 fasten to the railing 114 on the dockside. This may be seen in Function Box 320, and at this stage it is clear that the vessel 108 is now docked. Once docking has been completed, the system powers down and remains in a standby state awaiting the instruction of the system operator or user (Function Box 322).

It will of course be understood that the present invention has been described by way of example only, and that modifications of detail can be made within the scope of the invention.

What is claimed is:

1. A system configured to control and dock automatically a vessel, the system comprising:

one or more distance detectors;

at least one extendable arm, the arm including attachment means located at a far end thereof; and a control system including a store for storing at least one of a chart and a harbor/dock/mooring plan, in use, the control system configured to position the vessel, utilizing the vessel's movement and steerage means, and measured distances to other objects, adjacent the indicated berthing location, and activating the arm and attachment means to link a vessel with a dockside or another vessel at the indicated berthing location.

2. A system as claimed in claim 1, wherein activation is triggered when a pre-set distance to another vessel, the dockside and/or docking means is measured by the one or more distance detectors.

3. A system as claimed in claim 2, wherein the at least one extendable arm is located adjacent the perimeter of a vessel and wherein a distance detector is located adjacent thereto, in order to detect objects in the vicinity of the vessel.

4. A system as claimed in claim 1, wherein the at least one extendable arm is located adjacent the perimeter of a vessel and wherein a distance detector is located adjacent thereto, in order to detect objects in the vicinity of the vessel.

5. A system as claimed in claim 4, wherein the extendable arms are controlled by hydraulic means.

6. A system as claimed in claim 5, wherein the at least one extendable arm is stored, when withdrawn, in a hold, covered by a hatch, within the vessel.

7. A system as claimed in claim 4, wherein the at least one extendable arm is stored, when withdrawn, in a hold, covered by a hatch, within the vessel.

8. A system as claimed in claim 1, further comprising anchor means and anchor activation means.

9. A system as claimed in claim 1, wherein distance detectors are located around the sides of the vessel.

10. A system as claimed in claim 1, wherein the at least one extendable arm is stored, when withdrawn, in a hold, covered by a hatch, within the vessel.

11. A system as claimed in claim 10, wherein the hatch and/or arm further include means for causing closure of the hatch upon withdrawal, from an extended position of the arm.

12. A method of automatically docking a vessel, comprising the steps of:

providing from a store a plan of a harbor/dock/mooring of interest;

receiving an indication of a location within the plan for berthing;

positioning the vessel, utilizing the vessel's movement and steerage means, and measured distances to other objects, adjacent a desired berth; and extending at least one extendable arm including attachment means and causing linkage thereof with means provided on a dockside or other vessel.

13. A method as claimed in claim 12, further comprising the step of measuring wind speed, tide and/or current.

14. A method as claimed in claim 13, further comprising dropping anchor(s).

15. A method as claimed in claim 12, further comprising dropping anchor(s).

16. A method as claimed in claim 12, further comprising the step of reverting to a standby mode, wherein instructions from an operator or user are awaited.

17. A method as claimed in claim 12, wherein docking is carried out in accordance with the length, draught and/or displacement of a vessel.

18. A system configured to control and dock automatically a vessel, the system comprising:

one or more distance detectors;

at least one extendable arm, the arm including attachment means and an electricity supply receiving means for receiving an electricity supply located at a far end thereof; and a control system configured to activate the arm and attachment means to link a vessel with a dockside or another vessel.

* * * * *